United States Patent [19]

Georget

[11] Patent Number: 4,566,165

[45] Date of Patent: Jan. 28, 1986

[54] METHOD OF MANUFACTURING A CYLINDER FOR A SUGAR MILL

[75] Inventor: Jean-Pierre Georget, Douchy-les-Mines, France

[73] Assignee: Fives-Cail Babcock, Paris, France

[21] Appl. No.: 545,969

[22] Filed: Oct. 27, 1983

[30] Foreign Application Priority Data

Nov. 3, 1982 [FR] France ..... 82 18387

[51] Int. Cl.[4] ..... B02C 4/30

[52] U.S. Cl. ..... 29/121.6; 29/121.7

[58] Field of Search ..... 100/121, 155 R, 176; 29/148.4 D, 110, 121.6, 121.7

[56] References Cited

U.S. PATENT DOCUMENTS

| | | | |
|---|---|---|---|
| 3,101,510 | 8/1963 | Packham | 100/176 X |
| 3,969,802 | 7/1976 | Bouvet | 29/121.6 |
| 4,391,026 | 7/1983 | Casey et al. | 100/121 X |

*Primary Examiner*—Howard Goldberg
*Assistant Examiner*—John T. Burtch
*Attorney, Agent, or Firm*—Kurt Kelman

[57] ABSTRACT

The manufacture of a cylinder, particularly for use in sugar mills, which has an exterior surface defining circular grooves of a cross section having the shape of a triangle, each triangle having an apex at a bottom of the groove in a respective transverse plane extending substantially perpendicularly to the axis of the cylinder, and the bottom of each groove being in communication with longitudinal channels extending substantially parallel to the axis in the cylinder, is simplified by inserting plugs into radial channels in the cylinder in a plurality of the transverse planes before making the circular grooves which are cut into the plugs into the inner ends of which are formed circular slots of sufficient length to connect the grooves to the longitudinal channels.

6 Claims, 4 Drawing Figures

METHOD OF MANUFACTURING A CYLINDER FOR A SUGAR MILL

The present invention relates to a method of manufacturing a cylinder and, more particularly, a cylinder used in sugar mills for the extraction of juice from sugar cane, and to a cylinder so produced.

Cylinders of this type have an exterior surface defining circular grooves of a cross section having the shape of a triangle, each triangle having an apex at a bottom of the groove in a respective transverse plane extending substantially perpendicularly to the axis of the cylinder, and the bottom of each groove being in communication with longitudinal channels extending substantially parallel to the axis in the cylinder. These longitudinal channels permit the ready evacuation of juice extracted from sugar cane crushed between two such cooperating cylinders, especially if these channels were provided in the upper cylinder. The evacuation of the juice is then effected at the ends of the cylinder.

The manufacture of such a cylinder poses delicate problems, particularly with respect to establishing the communication between the bottom of the groove and the longitudinal channel.

It is the primary object of this invention to avoid the difficulties heretofore encountered in the manufacture of such cylinders and to provide a particularly simple and economical manufacturing method for cylinders of this type.

The above and other objects are accomplished according to the invention with a method which comprises the steps of boring radial channels in the cylinder in a plurality of the transverse planes until the radial channels are in communication with the longitudinal channels, fitting a plug having a blind hole at an inner end thereof in each one of the radial channels, making the circular grooves in the exterior surface of the cylinder, and making a circular slot in the bottom of each groove of a sufficient length to connect the bottom of the groove to the blind hole.

This manufacturing method according to the present invention provides a cylinder having an exterior surface defining circular grooves of a cross section having the shape of a triangle, each triangle having an apex at a bottom of the groove in a respective transverse plane extending substantially perpendicularly to the axis of the cylinder, and the bottom of each groove being in communication with longitudinal channels extending substantially parallel to the axis in the cylinder, which comprises radial channels in the cylinder in a plurality of the transverse planes, the radial channels being in communication with the longitudinal channels, a plug having a blind hole at an inner end thereof fitted in each one of the radial channels, and a circular slot in the bottom of each groove of a sufficient length to connect the bottom of the groove to the blind hole.

The above and other objects, advantages and features of this invention will become more apparent from the following detailed description of a now preferred embodiment thereof, taken in conjunction with the accompanying, somewhat schematic drawing wherein FIG. 1 is a side elevational view of a cylinder manufactured according to the invention;

Figure 1:
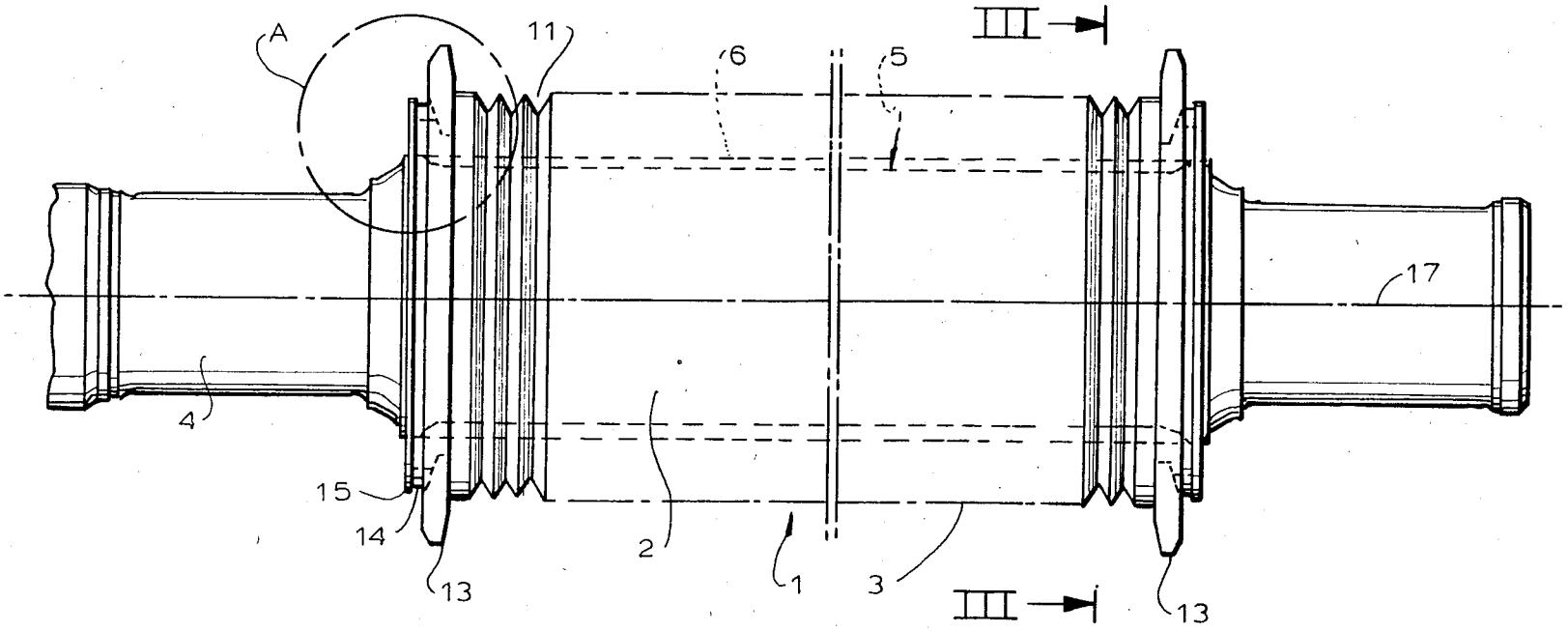

Referring now to the drawing wherein like reference numerals indicate like parts in all figures, there is shown cylinder 1 constituted by cylindrical body 2 encased in sleeve 3. The cylindrical body is integral with, or keyed to, shaft 4 for rotating the cylinder.

Figure 3:
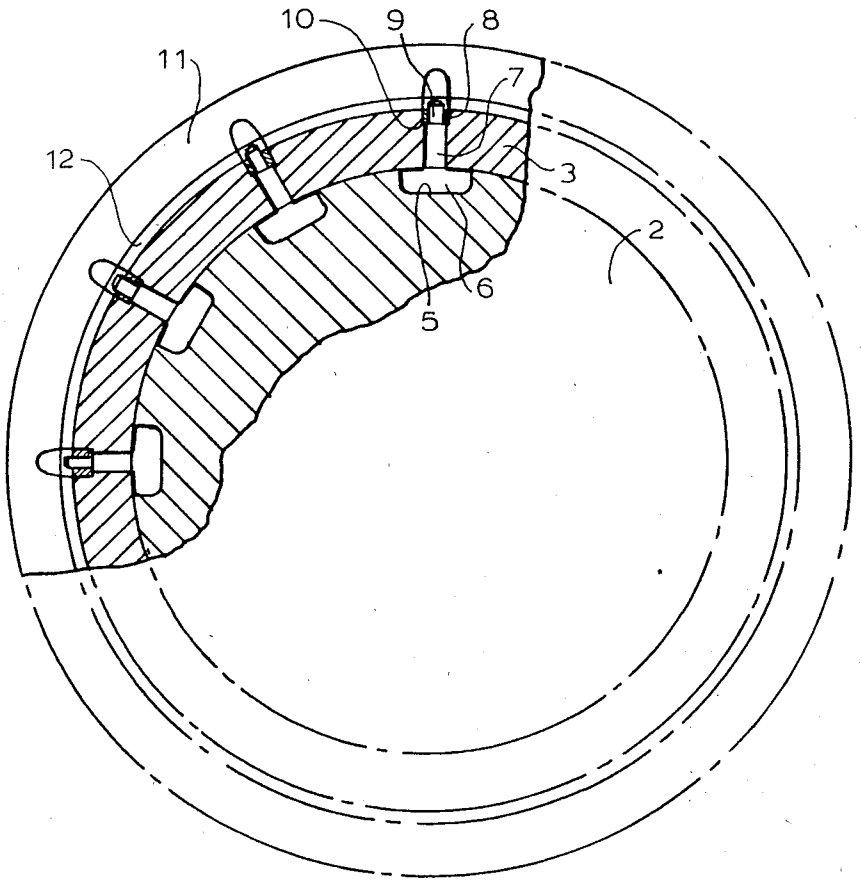
FIG. 3 is an enlarged transverse section of the cylinder along lines III—III of FIG. 1.

In the illustrated embodiment, longitudinal cuts 5 are made in the periphery of cylindrical body 2, a dozen such cuts being provided and spaced from each other along the periphery at equal angles or arcs. These cuts define longitudinal channels 6 with the internal wall of sleeve 3 and these channels, as shown in FIG. 3, are preferably rectangular in cross section.

Radial channels 7 are bored in the cylinder sleeve in a plurality of transverse planes until the channels are in communication with longitudinal channels 6. As shown in FIG. 3, the width of the longitudinal channels exceeds the diameter of radial channels 7. In the illustrated embodiment, a dozen such radial channels are provided in each selected transverse plane for communication with the dozen longitudinal channels.

Plug 8 having blind hole 9 at an inner end thereof is fitted into each radial channel 7. The plugs are preferably fitted and then bonded to the interior of the radial channels. Radial channels 7 have shoulders 10 on which the plugs are held while their outer ends are flush with the exterior surface of cylinder 1, as shown in dotted lines of FIG. 2.

Figure 2:
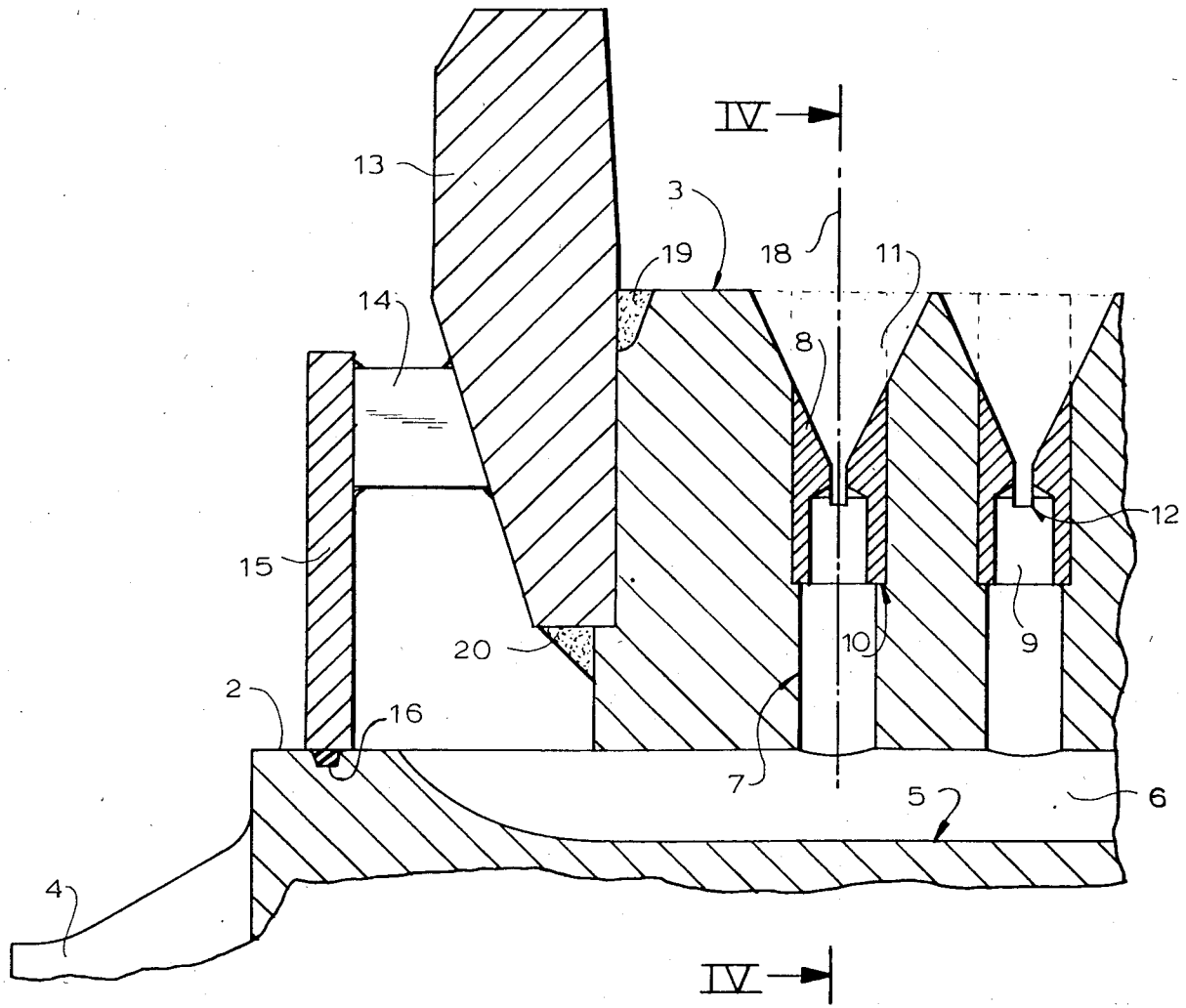
FIG. 2 is an enlarged axial section of portion A of the cylinder shown in FIG. 1.
Figure 4:
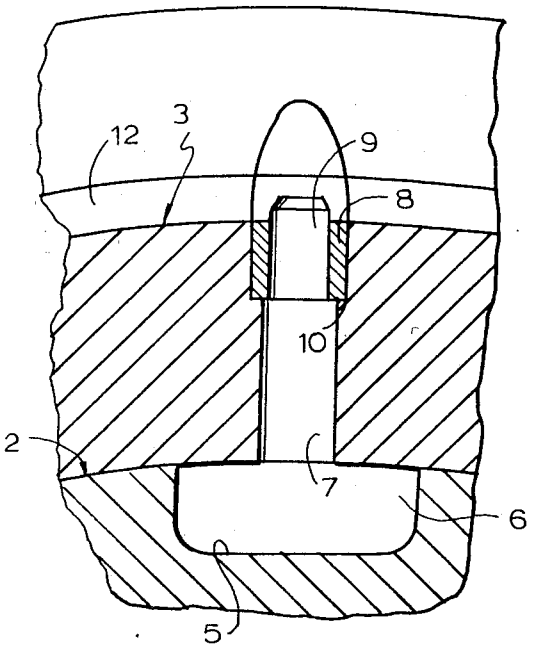
FIG. 4 is an enlarged transverse section along line IV—IV of FIG. 2.

Circular grooves 11 are now made in the exterior surface of the cylinder. The cross section of the circular grooves has the shape of a triangle, each triangle having an apex at a bottom of the groove in a respective transverse plane extending substantially perpendicularly to axis 17 of cylinder 1, which plane is defined by axes 18 of radial channels 7. As best shown in FIG. 2, circular grooves 11 cut into sleeve 3 as well as plugs 8. After these grooves have been cut into the exterior cylinder surface, the surface is saw-toothed in axial section.

Circular slot 12 is now made in the bottom of each groove 11, this slot being of a sufficient length to connect the bottom of the groove to blind hole 9 of plug 8. The circular slots are preferably of rectangular cross section. The slots are cut through each plug positioned in a respective transverse plane and provide communication between the bottom of each groove 11 with longitudinal channels 6 extending substantially parallel to axis 17 of cylinder 1. Sleeve 3 is of sufficient thickness to provide radial channels 7 and grooves 11 therein.

As shown in FIGS. 1 and 2, a passage for the flow of liquid, such as sugar juice, is provided at each end of cylinder 1 in communication with longitudinal channels 6. Each liquid flow passage is defined by flange 13 welded at 19 and 20 to a respective end face of sleeve 3 and deflector disc 15 mountd fluid-tightly about the cylinder and integral with flange 13. In the illustrated embodiment, toric gasket 16 is arranged in a groove in the periphery of cylindrical body 3 to provide a fluid-tight joint between the cylinder and the deflector disc, and radially extending connecting plates 14 connects flange 13 and deflector disc 15, six such connecting plates being equidistantly spaced about the periphery of the cylinder, for example.

While the present invention has been described hereinabove in connection with a now preferred embodiment, it will be clearly understood that variations and modifications may occur to those skilled in the art without departing from the spirit and scope of this invention, as defined in the appended claims which encompass all equivalent means and steps.

What is claimed is:

1. A method of manufacturing a cylinder having an exterior surface defining circular grooves of a cross section having the shape of a triangle, each triangle having an apex at a bottom of the groove in a respective transverse plane extending substantially perpendicularly to the axis of the cylinder, and the bottom of each groove being in communication with longitudinal channels extending substantially parallel to the axis in the cylinder, which comprises the sequential steps of (a) first boring cylindrical radial channels in the cylinder in a plurality of the transverse plane until the radial channels are in communication with the longitudinal channels, (b) fitting a plug having a blind hole at an inner end thereof in each one of the radial channels, the plugs having outer ends flush with the exterior cylinder surface and the blind holes being in communication with the longitudinal channels, (c) cutting the circular grooves in the exterior surface of the cylinder and the plugs, the bottoms of the grooves extending into the plugs fitted into the radial channels, and (d) making a circular slot in the bottom of each groove of a sufficient length to connect the bottom of each groove at the apex to the blind hole in each plug whereby the hole is opened and the bottom of each groove is in communication with a respective one of the horizontal channels.

2. The manufacturing method of claim 1, wherein the longitudinal channels are made by making longitudinal slots in the periphery of a cylindrical body and encasing the cylindrical body with a sleeve, the cylindrical body and the sleeve constituting the cylinder, and the sleeve being of sufficient thickness to provide the radial channels and the circular grooves therein.

3. The manufacturing method of claim 1, wherein the longitudinal channels and the radial channels in communication therewith are spaced from each other at equal angles.

4. The manufacturing method of claim 1, comprising the further step of bonding each plug to the radial channel into which it is fitted.

5. The manufacturing method of claim 1, wherein the circular slots in the bottoms of the grooves are rectangular in cross section.

6. The manufacturing method of claim 1, wherein the longitudinal channels are rectangular in cross section.

* * * * *